US008513508B2

(12) United States Patent
Pancino

(10) Patent No.: US 8,513,508 B2
(45) Date of Patent: Aug. 20, 2013

(54) UPRIGHT PIANO

(76) Inventor: Paolo Pancino, Venice (IT)

( * ) Notice: Subject to any disclaimer, the term of this patent is extended or adjusted under 35 U.S.C. 154(b) by 0 days.

(21) Appl. No.: 13/698,135

(22) PCT Filed: Jun. 10, 2011

(86) PCT No.: PCT/IB2011/001321

§ 371 (c)(1),
(2), (4) Date: Dec. 3, 2012

(87) PCT Pub. No.: WO2011/154825

PCT Pub. Date: Dec. 15, 2011

(65) Prior Publication Data

US 2013/0112060 A1 May 9, 2013

(30) Foreign Application Priority Data

Jun. 11, 2010 (IT) ..... VE2010A0028

(51) Int. Cl.
*G10C 3/18* (2006.01)

(52) U.S. Cl.
USPC ..... 84/240

(58) Field of Classification Search
USPC ..... 84/240
See application file for complete search history.

(56) References Cited

U.S. PATENT DOCUMENTS

| | | | | | |
|---|---|---|---|---|---|
| 851,001 | A * | 4/1907 | Doyle | 84/240 |
| 896,763 | A * | 8/1908 | Schimmel | 84/240 |
| 2,123,736 | A * | 7/1938 | Klein | 84/240 |
| 2,273,789 | A * | 2/1942 | Prevost | 84/240 |
| 2,436,875 | A * | 3/1948 | Socin | 84/240 |
| 2,844,984 | A * | 7/1958 | Dasenbrook et al. | 84/240 |
| 3,100,416 | A * | 8/1963 | Roehrig | 84/240 |
| 4,854,211 | A * | 8/1989 | Tanaka et al. | 84/240 |
| 4,879,939 | A * | 11/1989 | Wall | 84/240 |
| 5,022,302 | A * | 6/1991 | Guyon | 84/255 |
| 5,042,354 | A * | 8/1991 | Trivelas et al. | 84/240 |
| 5,583,306 | A | 12/1996 | Hayashida et al. | |
| 5,679,914 | A * | 10/1997 | Niitsuma | 84/687 |
| 6,054,641 | A * | 4/2000 | Inoue | 84/171 |
| 6,248,943 | B1 * | 6/2001 | Inoue | 84/423 R |
| 6,965,070 | B2 * | 11/2005 | Wenjun | 84/719 |
| 8,294,009 | B2 * | 10/2012 | Muramatsu et al. | 84/240 |
| 8,389,833 | B2 * | 3/2013 | Muramatsu et al. | 84/240 |
| 2010/0192748 | A1 * | 8/2010 | Inoue | 84/240 |
| 2011/0232456 | A1 * | 9/2011 | Muramatsu et al. | 84/241 |
| 2013/0112060 | A1 * | 5/2013 | Pancino | 84/240 |

FOREIGN PATENT DOCUMENTS

| | | |
|---|---|---|
| EP | 0689182 | 12/1995 |

* cited by examiner

*Primary Examiner* — Robert W Horn
(74) *Attorney, Agent, or Firm* — Themis Law

(57) ABSTRACT

An upright piano, wherein: a) within the overall lever-hammer, the total weight of the hammer butt plus balance hammer exceeds the weight of the hammer by at least 60%; b) the arm of the lever-hammer has a measurement of less than 65 millimeters; c) the center of gravity of the lever-hammer is shifted rearwards from the vertical passing through the pin in the opposite direction to the string by a distance exceeding one centimeter such that, at the moment of striking, the segment which joins the center of gravity to the pin of the lever-hammer forms with the vertical a positive angle of at least 7°; d) a spoon is added, symmetrical to and opposite the spoon fixed to the wippen on the other side of the rod of the damper, this spoon being hinged, by a lever provided with a counterweight, to a fixed structure.

7 Claims, 5 Drawing Sheets

UPRIGHT PIANO

FIELD OF THE INVENTION

The present invention relates to an upright piano.

BACKGROUND OF THE INVENTION

Horizontal pianos (grand and table) and upright pianos are known. These pianos differ substantially in that part regarding the action mechanism; in horizontal pianos the hammers move from the bottom upwards, whereas in upright pianos they move forwards and backwards.

FIG. 1 shows a schematic lateral view of an upright piano action mechanism of the state of the art, illustrating inter alia those elements lying within the dashed-line area, i.e. the hammer 22, the shank 20, the hammer butt 18 and the balance hammer 19, all pivoted on the pin 21 and rigidly connected together into a single lever-hammer 3. Of these elements, the hammer has a movement constantly close to the horizontal line, whereas the hammer butt 18 and balance hammer 19 move close to the vertical. However, given that the weight of the hammer is preponderant, the center of gravity of this lever-hammer advances towards the string 1 during playing until it exceeds the vertical through the pin 21. The action of the lever becomes counter-productive, this signifying that at a certain moment the resistance becomes zero and hence the hammer disappears from the pianist's perception. All that remains, in reality, is a resistance due to other parts of the action mechanism (key 2 and wippen 10) and in particular to the energy of the springs, this creating an artificial situation, totally different from that of the grand piano. In this respect, in a grand piano the resistance perceived by the pianist is due to an angular momentum of the hammer which is greater than that of the upright piano, and in particular constant until reaching the string, whereas in the upright piano the angular momentum of the lever-hammer 3, already modest from the start, rapidly decreases to become negative. This determines total loss of control of the hammer at the moment of striking and hence loss of touch, i.e. of the ability to influence the tone color and expressive characteristics of the sound, which can be decided only at that moment.

Physically, the touch consists of determining the attack transient, i.e. in that apparently chaotic stage which precedes the stationary wave. In the piano the stationary wave comes in the continuation of the sound after striking, the pianist being unable to directly intervene in this continuation. Consequently, determining the attack transient by controlling the modalities of encounter of the hammer with the string is all that the pianist can do to influence the sound quality.

In the upright piano the only one of these modalities which can be decided at the hammer departure is the sound intensity, hence the pianist is only able to control the vibration amplitude, which is determined by the initial launch energy.

To this must be added the fact that the facility to control the sound is further diminished by the action of the springs (the spring 28 of the hammer butt 18 and the spring 27 of the damper 26 in FIG. 1), the dynamics of which cannot be modified at the act of the musical execution. Of these, the spring 28 of the hammer butt 18, which ensures return of the hammer 22, interferes directly on the hammer stroke until it entirely replaces the nullified resistance with its own energy, its negative effect on touch control being hence evident. On the other hand the spring 27 of the damper 26 acts on an intermediate lever of the action mechanism, i.e. the wippen 10. However this is more energetic than the other, its negative effect on the touch (presumably not less than that of the spring 28) manifesting itself particularly as a closure of the sound (extinction transient), which is totally uncontrollable by the pianist.

Hence for clarity the touch must also be defined from a subjective viewpoint, i.e. in the perception of the pianist. Touch control is a feedback process, i.e. a certain muscular action determines a certain sound effect, this influencing in real time the next muscular action, and so on until an automatic process is created, constituting one of the fundamentals of the pianist's technique, i.e. the capacity to give musical meanings to the sound. However this process starts only from a certain threshold (i.e. from a minimum perceptive level), and it can be considered that this threshold is a substantially objective detail, dependent only in certain cases, and only partially, on subjective situations, and that to attain it certain objective physical conditions are necessary which require particular characteristics of the instrument. This means that if the pianist's fingers do not "sense" the hammer because of the limits of the instrument, the ear cannot hear a variation in timbre such as to influence the motory action. Below a threshold defined in this manner, evidently no feedback is possible, which objectively means that the instrument, as it does not possess it, does not enable touch.

This threshold is natural in a grand piano, given that the angular momentum of the hammer is sufficiently high and, as already stated, substantially constant, but in an upright piano it appears to be unattainable. However a solution to this problem exists, based on utilizing a "lens effect", a perceptive phenomenon by virtue of which the pianist can continue to sense the initial resistance of the lever-hammer until reaching the string or, perhaps more exactly, perceives this resistance as if the angular momentum of the hammer at the moment of striking were the same as that at the start. As a particular study of the causes of this phenomenon has not been possible, it can be assumed that it depends on the reaction time of our perceptions which, both for that regarding hearing (and also sight) and for that regarding the grand musculature, is generally defined as $^{75}/_{1000}$ of a second. Hence, touch in an upright piano is probably possible only when the stroke of the hammer 22 has a duration of less than that time, hence making separate perception of the initial angular momentum of the stroke of the lever-hammer 3 from the final momentum impossible, if the final momentum is positive and reaches a perceptible minimum.

SUMMARY OF THE INVENTION

The object of the invention is therefore to make it possible to manifest this "lens effect", which can be achieved only by a coordinated and unitary system of interventions able to increase both the angular velocity and the overall value of the angular momentum of the lever-hammer 3, and to withdraw the barycentre B of this lever from the vertical V through the pin 18 (in the opposite direction to the string 1), for a further necessary increase in the angular momentum. With this coordinated unitary system there is also associated gravity rather than spring operation, both of the return of the hammer 22 and of the action of the damper 26, with the advantage of eliminating, together with the springs 27 and 28, those other elements in the action mechanism action which are not controllable by the pianist.

This object is attained according to the invention by an upright piano as described hereinafter.

BRIEF DESCRIPTION OF THE DRAWINGS

Some possible embodiments of the present invention are described hereinafter by way of non-limiting example with reference to the accompanying drawings, in which.

DETAILED DESCRIPTION OF EMBODIMENTS OF THE INVENTION

Figure 1:
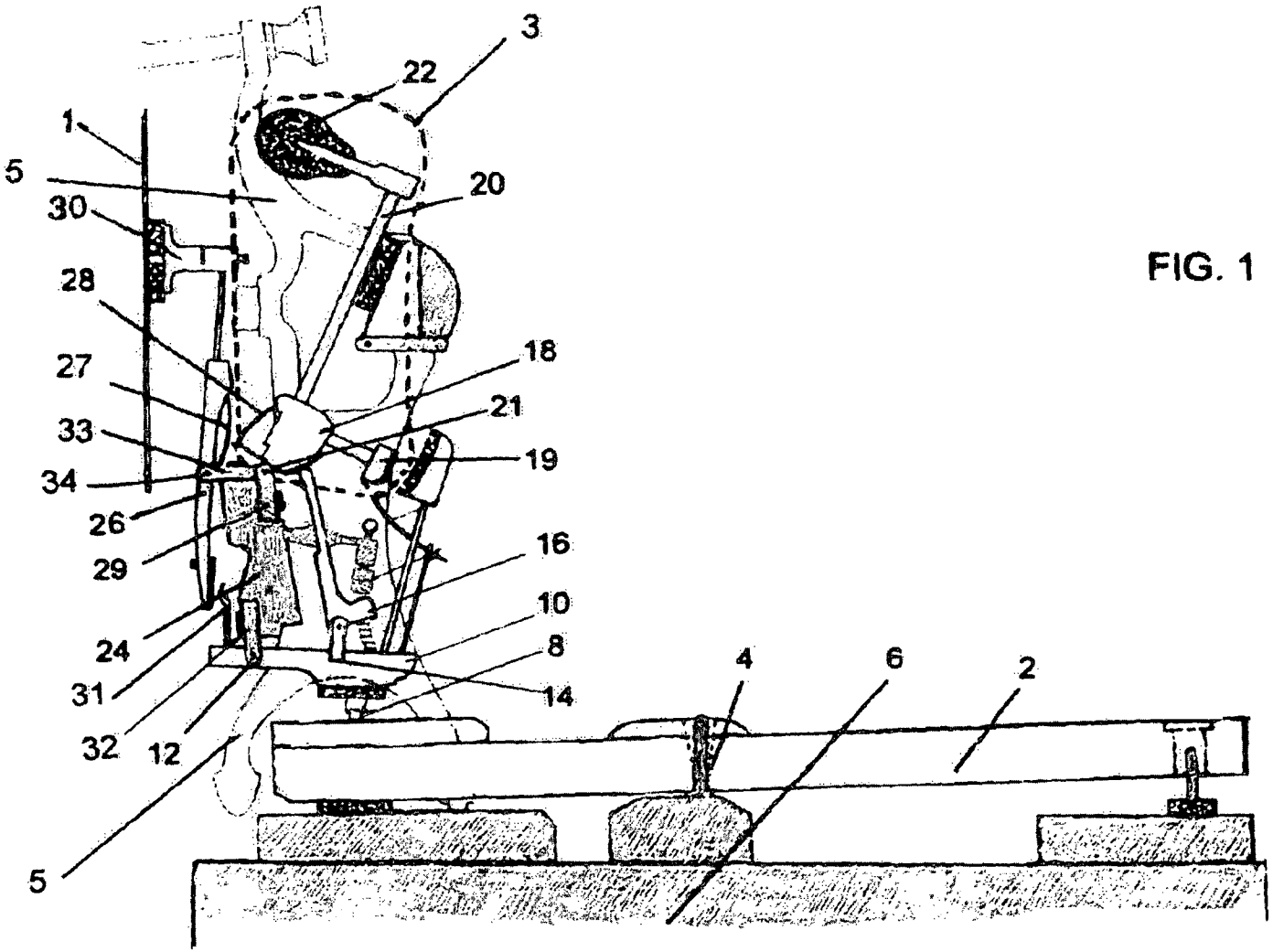
FIG. 1 shows the action mechanism of an upright piano according to the state of the art.

As can be seen from the drawings, FIG. 1 represents in lateral schematic view the action mechanism of an upright piano according to the current state of the art, the action mechanism comprising substantially a key 2 pivoted at 4 to the base of the keyboard 6 and provided at one end with a pilot 8 interacting with a wippen 10 pivoted at 12 to the action bar 24. Rigidly fixed to the wippen 10 there is the fork 14 of the jack 16 (or first escapement lever), the upper end of which interferes with the hammer butt 18 supporting the shank 20 of the hammer 22. The hammer butt 18 (and with it the entire lever-hammer 3, which as already stated is circumscribed by a dashed line) is pivoted on the pin 21 to the butt fork 29 mounted on the action bar 24 of the action mechanism, to which the wippen 10 is pivoted on the pin 12.

Figure 2:
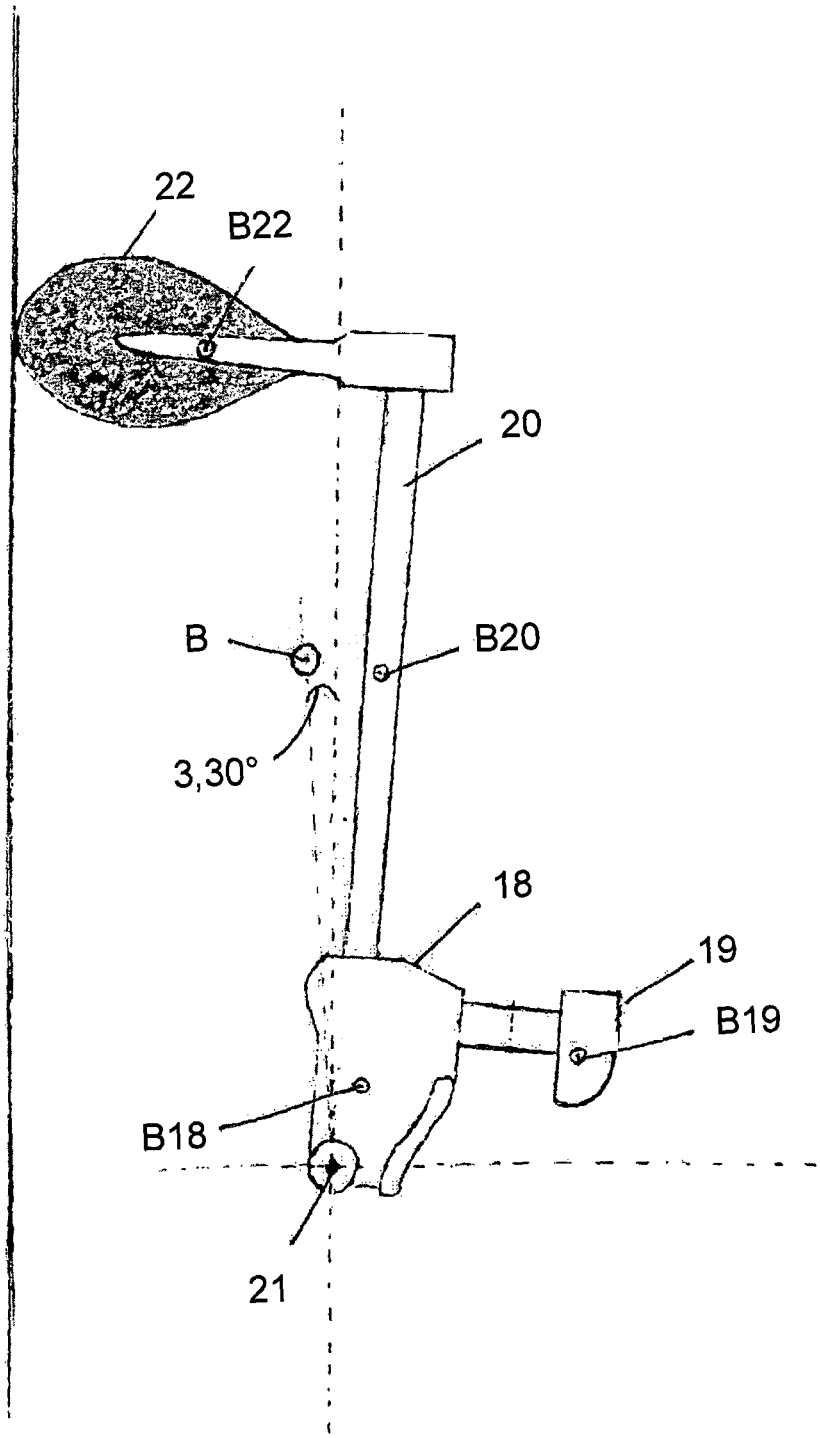
FIG. 2 shows just the lever-hammer 3 with an indication of the barycentres b of the hammer 22, of the shank 20, of the hammer butt 18, and of the balance hammer 19, together with the overall barycentre B, according to the current state of the art.

FIG. 2, which represents the lever-hammer 3 alone, shows the centers of gravity of the hammer b22, of the shank b20, of the hammer butt b18, and of the balance hammer b19, together with the resultant overall center of gravity B. As can be seen from the figure, the arm of the lever 3, i.e. the segment which joins the center of gravity B to the butt pin 21, measures 73 millimeters, and with the vertical V through the pin 21 forms a negative angle of more then 3°, hence remaining closer to the string 1 than this vertical V (with a distance of the pin 21 from the string 1 of 50 millimeters). Under these conditions, any touch is certainly impossible.

Figure 3:
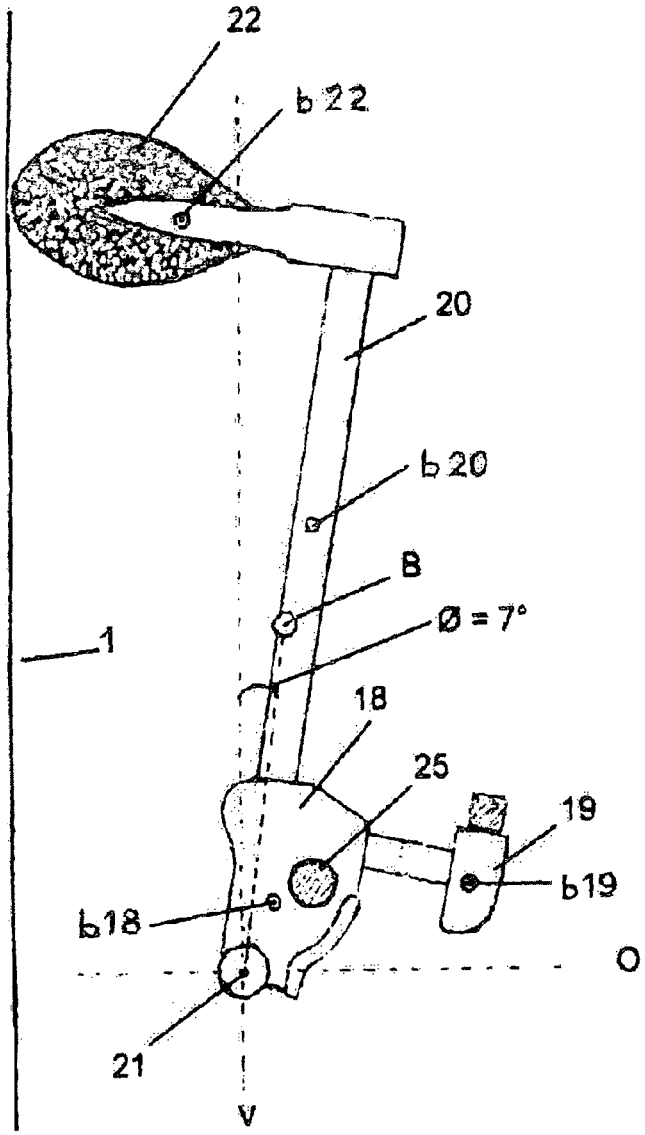
FIG. 3 shows the same centers of gravity relocated according to the invention, in one of the proposed embodiments.

FIG. 3 shows in schematic form the coordinated group of measurements forming the substance of the invention. The arm B-21 of the lever 3 is shortened to 60 millimeters, and the angle formed by this arm to the vertical V through the pin 21 becomes positive at 7° instead of negative. These results were achieved by two types of intervention. Firstly, by increasing the weight of the hammer butt 18 and of the balance hammer 19 such that their total weight exceeds the weight of the hammer 22 by more than 60%. Secondly, by shifting the pin 21 of the hammer butt 18 towards the string 1, together with the entire action mechanism, to a distance of 38 millimeters therefrom (against the 50 millimeters of FIG. 2), hence making the barycentre B advance beyond the vertical through the pin 21 until it reaches the aforesaid angle of 7°.

The measurements represented in FIG. 3 will now be stated precisely to further clarify the logic of the interventions required to solve the problem stated in the introduction. In the piano of the experiment (again in FIG. 3) the hammer 22 weighs 7.3 grams (reference is made here and hereinafter to the "middle C" hammer which in new pianos has generally a weight greater by at least 1 gram), the shank 20 weighs 1.8 grams, the hammer butt 18 weighs 6 grams, the balance hammer 19 weighs 1.2 grams. A counterweight of 2.8 grams has been applied to the hammer butt at 25, and a counterweight of 2.2 grams to the balance hammer at 26.

The consequences resulting from the interdependence of these values can now be explained in concrete form. If, instead of increasing the weight of the hammer butt at 25 and of the balance hammer at 19, the weight of the hammer 22 were to be reduced until it became 37.5% less than their total weight (i.e. to 4.5 grams), the necessary reduction in the arm B-21 would be likewise achieved together with the consequent increase in angular velocity. The consequences of this hypothesis will be seen hereinafter, which involve a lesser overall value of the angular momentum. In addition it should be noted that in the solution represented in FIG. 3 the interventions could also be calculated differently in relation to possible differences in the measurements of the various pieces, or to choosing to increase the weight of the hammer butt alone, or to other choices (which will be mentioned hereinafter) with regard to shifting the center of gravity B. In any event it must be noted that the substance of the present invention is certainly not the counterweights, and that the defined weight ratio between the hammer 22 and the combined hammer butt 18 and balance hammer 19 can be achieved by modifying the weights and designs of the individual parts, including by the use of different materials, to obtain in any manner the system of measurements proposed in the present invention.

By way of example, with regard to the hammer butt 18 we propose a construction of light alloy or another material not much heavier than wood, the thickness of which (less than the current 8 millimeters) should be modulated such as to determine the position of the center of gravity according to design choices, and in any event as close as possible to the horizontal O through the pin 21 and to the pin itself (obviously on the opposite side of this pin 21 to the string 1).

That which must remain unvaried is the system of measurements which we have defined in the introduction. In particular, the guiding principle must be the clear perception of the change in sound (as if the sound came alive) which is achieved when this system of measurements is fully realized, and which does not become stable prior to that moment.

The assumption could also be made of a different design for the pieces involved in the dynamics of the hammer 22, but this would involve modifications in the action mechanism which go beyond the framework of the present invention, even though they could constitute a valid application thereof. We would merely mention the fact that acting on the wippen 10 or on the key 4 could be useful in influencing the angular velocity or to compensate the greater weight of the lever-hammer 3. However we consider it necessary, for the effects of touch control in an upright piano, that in the perception of the pianist the resistance of the lever-hammer 3 must always prevail, and in particular that part of the resistance which is determined by the force of gravity. The key 2 and the wippen 10 serve only to launch the hammer 22. It is the hammer which produces the sound, it is the length of its arm which stabilizes the possible launching velocity, and it is only the total weight of the lever-hammer 3 which defines the sound efficiency of the instrument, not the weight of other parts of the instrument (or even less the weight of the muscular masses of the pianist).

Shifting the pin 21 rearwards with respect to the vertical V is one of the essential elements of this invention, and as seen in FIG. 3 can be achieved by shifting the pin 21 of the hammer butt 18 rearwards to a distance of 38 millimeters from the string 1. However this solution, which enabled the required object to be attained in the experimental stage, may present drawbacks because shifting the action mechanism towards the string 1 can in certain cases interfere with the other structures of the instrument, and in any event involves the need to adapt the action mechanism to regulate the stroke of the hammer 22 and ensure its exact direction. On the other hand the attempt to rearwardly shift the center of gravity B by rearwardly shifting the hammer butt center of gravity b18 and in particular of the balance hammer b19, given the horizontal direction of this shifting, can shift the pin 21 away instead of bringing it nearer as would be necessary to reduce the length of the arm B-21, this obviously reducing the overall effectiveness of the interventions.

In effect, the only piece of the lever 3 in which the necessary horizontal displacement of the center of gravity does not vary, for equal weight and length of the arm B-21, is the hammer 22. Because of this, in FIG. 4 we propose a different version of this hammer 22, as a further possible aspect in implementing the present invention, as an alternative to the solutions described FIG. 3 and in the text. This further detail of the invention is the hammer with variable barycentre 22B, compared in the drawing with the original hammer 22. This drawing represents only one of the possible versions of the basic idea: a hammer which, without increasing (and if possible reducing) the overall weight, enables an adjustable counterweight to be applied to the rear of the shank, to achieve rearward shift of the center of gravity. As a note to the description of FIG. 3 we mentioned a hammer of 4.5 grams, which would enable a weight increase of the hammer butt 18 and balance hammer 19 to be avoided. We would state now that this solution, including in combination with the horizontal shifting of the center of gravity B under discussion, presents limits. It presumably gives a sufficient auditory perception of the touch, but not the sensation of lifting the weight of the hammer and of being able to control it, this being important in making the upright piano totally comparable to a grand piano. This effect, clearly perceptible to all pianists (although not all possess a conscious auditory perception of touch) is in fact due only to a substantial increase in the angular momentum of the lever-hammer 3, and hence to a real increase in the weight, and not only the velocity, of this lever.

Figure 4:
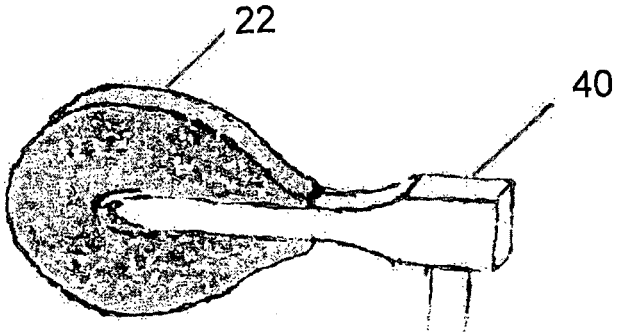
FIG. 4 illustrates the proposal of a hammer of variable center of gravity, compared with the current hammer.
Figure 4:
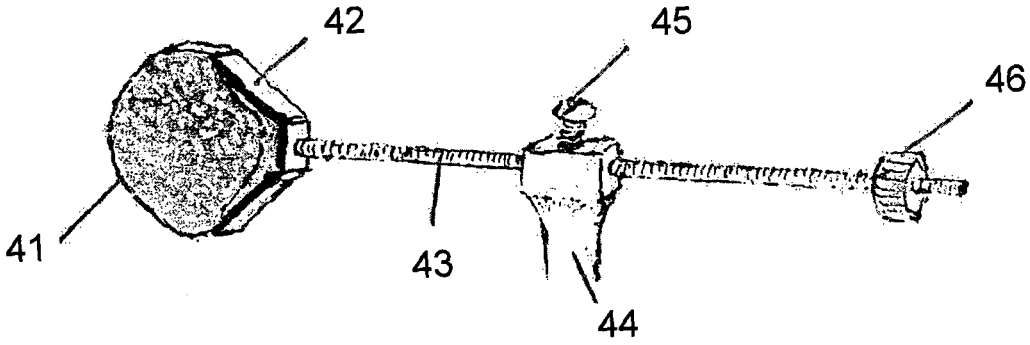

Hence in the particular aspect of the invention illustrated in FIG. 4, the weight gained is used not to avoid these weight increases, but to make the rearward shifting of the center of gravity B possible by adding the adjustable counterweight 46.

As can be seen in this figure, the felt element 41 has at the striking point the same shape and thickness as the hammer 22, but with the weight about halved. The plate 42 and the threaded rod 43 (of magnesium alloy or carbon fibre) enable the felt element to be retained by the former (to prevent rear and lateral dispersions of the thrust at the moment of striking) and the counterweight 46 to be regulated by the latter to shift the center of gravity B rearwards, again with a possible weight reduction compared with the traditional wooden support 40.

The hypothesis of a "lightweight" hammer appears to be in contrast with the idea that satisfactory sound dynamics and volume in an upright piano require a hammer of large weight and dimensions, an idea not without basis in reality. However it remains a fact that providing a hammer 22 of large weight, given its distance from the pin 21, causes a corresponding reduction in the angular velocity of the lever-hammer 3, whereas it is without doubt that the weight which matters is not that of the hammer alone, but the total weight of the lever-hammer 3.

As can be clearly seen in the drawing of FIG. 4, the rod 43 is screwed to the head of the shank 44 via a through hole, and locked in the correct inclination (i.e. the inclination exactly corresponding to that of the string) by the screw 45, hence enabling precise adjustment, which is not possible with a current hammer 22 (again see FIG. 4), in which the block 40 is normally drilled in the factory. However it should be noted that the screw may not be sufficiently effective, and that other systems for locking the hammer inclination can be conceived. Such systems, and any different design for the hypothesis illustrated in FIG. 4 (i.e., we repeat, a hammer with variable center of gravity by virtue of a horizontally shiftable counterweight), are to be considered as possible variants falling within the scope of the invention.

The hammer 22B also solves a problem which was noted during the experimental stage of the present invention: given the very small limits of tolerance in defining the position of the center of gravity B, any repeated filing of the felt elements (usual in the manufacture of the instrument) inevitably causes this center of gravity to advance, and just a few millimeters are sufficient for the piano to lose touch. The ease with which the necessary correction can be made with this new type of hammer is evident.

As an alternative to that proposed heretofore, withdrawal of the barycentre B from the string and from the vertical V through the pin 21 is also possible by forwardly inclining (towards the keyboard) the string 1, together with all the action mechanism. We mention this hypothesis, although protected by a USA patent until June 2012, to express the opinion that a modification of this type could not in itself give an increase in the angular velocity of the lever 3, and hence give a real auditory perception of touch. However if used, to an extent of at least 5°, together with rebalancing of the weights within the scope of the lever-hammer 3 proposed in the present invention, it would solve the problem of horizontally shifting the center of gravity B, as an alternative to the aforedescribed solutions.

In the introduction it was stated that the spring problem was among those constituting an obstacle to the achieving of touch, which the invention proposes to solve. We would note that in the solution proposed in FIG. 3, a natural return of the hammer 22 is achieved (i.e. due only to the force of gravity), so enabling the spring 28 of the hammer butt 18 to be eliminated. We now propose, in FIG. 5, a simple mechanism for gravity operation of the damping system (which however remains that currently in us), enabling the spring 27 of the damper 26 to be eliminated.

The first drawing (FIG. 5A) describes the operation of the damping system of the state of the art. The spring 27 presses the damper 30 against the string 1. When the key 2 (see FIG. 1) is lowered, the pilot 8 raises the wippen 10 which, pivoted by the pin 12 to the action bar 24 (fixed structure), causes the spoon 31 to act as a lever. By pressing the end of the rod 26 pivoted to the action bar 24 by the pin 34, this spoon 31 withdraws the damper 30 from the string 1, which returns to its initial position on allowing the key 2 to rise, so releasing the action of the spring 27.

Figure 5C:
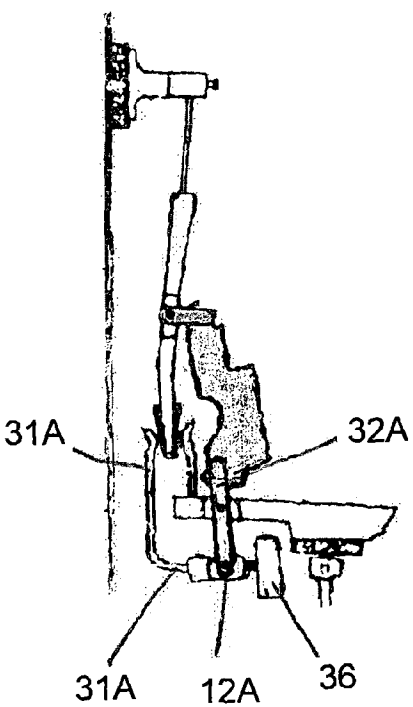
FIG. 5 shows two possible versions of a gravity operated sound damping system, compared with the known art.
Figure 5B:
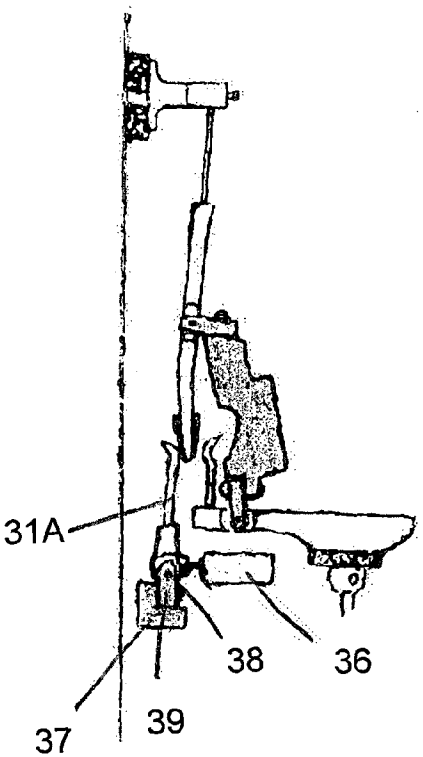
Figure 5A:
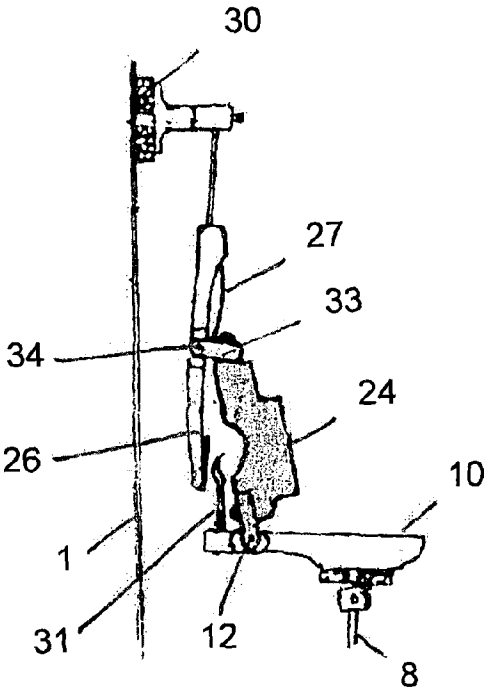

In the drawing B of FIG. 5, the spring 27 of the preceding drawing is replaced by the spoon 31A, equal and opposite to the spoon 31. As can be seen from the drawing, the spoon 31A is rigid with the lever 35, pivoted by the pin 38 to the fork 39, fixed to the bar 37, a fixed structure (possibly of metal, shown in section in the drawing), and must be rigidly connected by suitable uprights, not shown in the figure, to the base of the keyboard 6 (with reference to FIG. 1), so remaining independent of the action mechanism, or to the frame 5 (again see FIG. 1) of the action mechanism.

Again in FIG. 5, the drawing C represents a variant of the said action mechanism. In this variant, the lever 35A is pivoted by the pin 12A to the same fork 32A which by the pin 12 pivots the wippen 10 to the action bar 24. As can be seen in the drawing, this fork 32A is a double fork, with two pins (12, 12A).

Both in the arrangement of 5B and in that of 5C an adequate space is required to enable the necessary movement of the counterweight 35 or 35A. In large form pianos the problem does not exist, the pilot 8 being longer than it appears in FIG. 1, whereas in other cases the end of the key 2 has to be modified by modifying it.

From what has been stated, it is clear that the action mechanism of the upright piano modified according to the invention presents evident advantages, and in particular:

gives touch to an upright piano, defines a system of interdependent measurements to achieve this result in a manner which is not random or intuitive, but instead based on objective elements, enables the proposed basic result to be achieved by different design solutions obtainable by combining together the different proposed solutions in various degrees, with the different gravitational arrangement of the lever-hammer 3 it gives the pianist not the perception of any type of resistance, but the clear sensation of lifting the weight of the hammer 22 and of being able to manoeuvre it exactly as in a grand piano, with the high angular momentum of the lever-hammer 3 the sound possibilities of the instrument, which can be controlled with greater precision, are more greatly exploited, the use of the solution comprising the variable barycentre hammer 22B offers those facilities for precise hammer regulation which do not exist in current pianos, it enables the lever-hammer 3 to return by force of gravity alone, making it possible to avoid those negative effects on touch due to the use of the spring 28, it enables the sound to be dampened by gravitational force, hence making it possible, given the elimination of the spring 27, to provide total performance control, including sound closure, without substantially modifying the current operating system for the damper 26.

The invention claimed is:

1. An upright piano, characterised in that:

a) within the overall lever-hammer 3, the total weight of the hammer butt (18) plus balance hammer (19) exceeds the weight of the hammer (22) by at least 60%;

b) the arm of the lever-hammer (3), i.e. that segment which joins the overall barycentre B of said lever-hammer (3) to the pin (21) of the hammer butt (18), consequently has a measurement of less than 65 millimeters;

c) the barycentre B of the lever-hammer (3) is shifted rearwards from the vertical V passing through the pin (21) in the opposite direction to the string (1) by a distance exceeding one centimeter such that, at the moment of striking, the segment which joins the barycentre B to the pin (221) of the lever-hammer (3) (i.e. the arm of this lever) forms with the vertical V a positive angle of at least 7°;

d) a spoon (31A) is added, symmetrical to and opposite the spoon (31) fixed to the wippen (10) on the other side of the rod (26) of the damper (30), this spoon (31A) being hinged, by a lever (35) provided with a counterweight (36), to a fixed structure (39, 37, 6; 39, 37, 5; 32A, 33).

2. An upright piano as claimed in claim 1, characterised in that, without changing the total weight of the hammer butt (18) plus balance hammer (19), the weight of the hammer (22) is reduced by at least 37.5%.

3. An upright piano as claimed in claim 1, characterised in that the pin (21) of the hammer butt (18) is made to approach the string (1) to a maximum distance of 38 millimeters therefrom.

4. An upright piano as claimed in claim 1, characterised by being provided with a hammer (22B) in which, by virtue of a counterweight (46) slidable along a rod (43), the barycentre B of the lever-hammer (3) is withdrawn from the vertical V through the pin (21) in the opposite direction to the string (1), by a distance exceeding one centimeter.

5. An upright piano as claimed in claim 1, characterised in that the spoon (31A) is pivoted, via the pin (38) of the lever (35) provided with counterweight (36), to the fork (39) rigid with the bar (or action bar) (37), which itself is rigidly connected to the keyboard base (6).

6. An upright piano as claimed in claim 1, characterised in that the spoon (31A) is pivoted, via the pin (38) of the lever (35) provided with counterweight (36), to the fork (39) rigid with the bar (or action bar) (37), which itself is rigidly connected to the frame (5) of the action mechanism.

7. An upright piano as claimed in claim 1, characterised in that the spoon (31A) is pivoted, via the pin (12A) of the lever (35) provided with counterweight (36), to the double fork (32A), rigidly connected to the action bar (33) of the action mechanism.

* * * * *